United States Patent [19]

Harada

[11] Patent Number: 4,580,970

[45] Date of Patent: Apr. 8, 1986

[54] WICK HOLDER APPARATUS FOR KEROSENE HEATER

[75] Inventor: Toyohei Harada, Nara, Japan

[73] Assignee: Matsushita Electric Industrial Co., Ltd., Osaka, Japan

[21] Appl. No.: 664,749

[22] Filed: Oct. 25, 1984

[30] Foreign Application Priority Data

Oct. 28, 1983 [JP] Japan ..... 58-203016
Nov. 2, 1983 [JP] Japan ..... 58-170391[U]

[51] Int. Cl.[4] ..... F23D 3/02; F23D 3/24

[52] U.S. Cl. ..... 431/302; 431/304; 431/320; 431/298; 126/96

[58] Field of Search ..... 431/120, 302, 304, 305, 431/306, 307, 248, 320, 325, 344; 126/96

[56] References Cited

U.S. PATENT DOCUMENTS

| | | | |
|---|---|---|---|
| 388,609 | 8/1888 | Yanez | 431/298 |
| 1,327,858 | 1/1920 | Brennan | 431/298 |
| 1,374,619 | 4/1921 | White | 431/302 |
| 1,403,010 | 1/1922 | Chadwick | 431/303 |
| 1,432,430 | 10/1922 | Veenboer | 431/298 |
| 1,981,107 | 11/1934 | Jefferson | 431/298 |
| 2,145,878 | 2/1939 | Jefferson | 431/302 |
| 2,226,793 | 12/1940 | Walters | 431/302 |
| 3,388,961 | 6/1968 | Hebard | 431/307 |
| 4,416,616 | 11/1983 | Shimizu et al. | 431/325 |
| 4,437,832 | 3/1984 | Amano et al. | 431/298 |
| 4,458,664 | 7/1984 | Uchida et al. | 431/307 |
| 4,480,987 | 11/1984 | Mandai et al. | 126/96 |
| 4,515,557 | 5/1985 | Nishikawa et al. | 126/96 |

FOREIGN PATENT DOCUMENTS

| | | | |
|---|---|---|---|
| 0005229 | 1/1979 | Japan | 431/325 |
| 0105333 | 8/1979 | Japan | 431/307 |
| 0150709 | 9/1982 | Japan | 431/304 |
| 0060109 | 4/1983 | Japan | 431/325 |

OTHER PUBLICATIONS

Nicely, D. C., "Synthetic Fiber Webs", *Tappi*, Jul. 1966; vol. 49, No. 7 (pp. 114A–116A).

*Primary Examiner*—Samuel Scott
*Assistant Examiner*—Helen Ann Odar
*Attorney, Agent, or Firm*—Birch, Stewart, Kolasch & Birch

[57] ABSTRACT

The disclosure is directed to a wick holder apparatus for a kerosene heater including a cylindrical guide wick tube erected on the bottom portion of an oil tank, a cylindrical outer wick tube disposed around the guide wick tube and a cylindrical wick concentrically disposed for vertical movements in an annular gap between the guide wick tube and the outer wick tube, and characterized in that there are further provided a wick holding tube releasably attached to the wick for movement in one unit, and a wick moving tube provided for vertical movement in the oil tank and releasably engaged with the wick holding tube, with the wick holding tube being provided with resilient engaging pieces which are engageable with corresponding engaging holes or apertures formed in the wick moving tube through rotation of the wick holding tube for facilitation of attaching or detaching of the wick.

8 Claims, 15 Drawing Figures

Fig. 2 (A) PRIOR ART
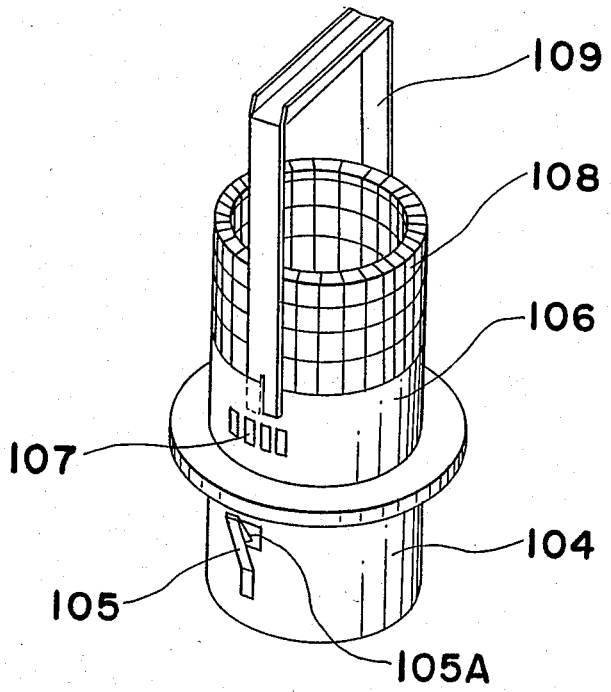
Fig. 2(B) PRIOR ART
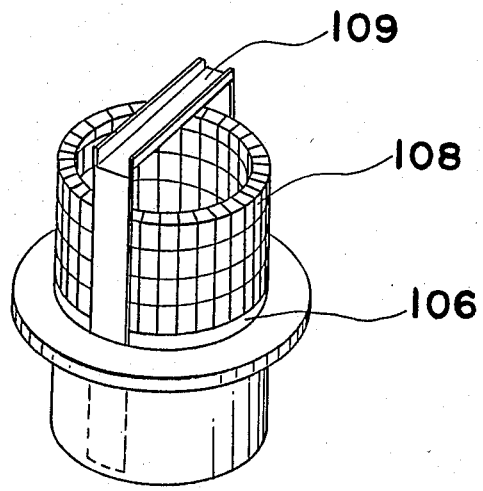

WICK HOLDER APPARATUS FOR KEROSENE HEATER

BACKGROUND OF THE INVENTION

The present invention generally relates to a holding arrangement or holder apparatus of a cylindrical wick for a kerosene heater and more particularly, to a wick holder apparatus so arranged that the wick thereof may be readily attached thereto or detached therefrom.

Generally, kerosene heaters which employ cylindrical wicks are adapted to effect burning and extinguishment through vertical movements of the wicks. However, the wick of the kerosene heater of the above described type has such disadvantages that if it is used for a long period, tar tends to adhere to the forward edge of the wick, thus resulting in deterioration in the state of burning or obstructing smooth upward and downward movements of the wick. Moreover, there is such a problem that, even when the wick has not been used for a long period, if a fuel containing water should be used, the wick undesirably draws in or sucks up the water in the fuel, giving rise to the deterioration of the state of burning in the similar manner as above or inviting various other inconveniences.

Therefore, in the kerosene heaters of the above described type, it has been a common practice to replace the wick when tar has adhered to the wick or water is drawn into the wick as described above. However, for the replacement of the wick, it is necessary to disassemble an outer cabinet of the kerosene heater or an outer wick tube surrounding the outer periphery of the wick, thus requiring very troublesome procedures.

In order to overcome the disadvantages as described so far, there have recently been proposed wick holder apparatuses as shown in FIGS. 1(A) and 1(B) and 2(A) and 2(B).

In the arrangement of FIGS. 1(A) and 1(B) disclosed in Japanese Utility Model Publication Jitsukosho No. 55-7682, the cylindrical wick is divided into an upper wick portion 100A for burning and a lower wick portion 100B for drawing in or sucking up a fuel at its soft lower portion 100B' accommodated in a fuel tank (not shown), and these wick portions 100A and 100B are respectively applied onto cylinder members 101 and 102 which are fitted together into one unit so that the upper wick portion 100A above a fire plate portion may be readily attached onto or detached from the lower wick portion 100B. In the conventional arrangement as described above, however, since the wick is separated into two portions, i.e. the upper wick portion 100A and lower wick portion 100B including the soft lower portion 100B' for drowing up a fuel, with the cylinder members 101 and 102 being respectively applied to said wick portions 100A and 100B, not only the number of parts involved is increased, but the arrangement becomes bulky in volume, thus resulting in a high cost and an inconvenience during storage and handling.

Meanwhile, in the wick holder of FIGS. 2(A) and 2(B) disclosed in Japanese Laid-Open Utility Model Application Jitsukaisho No. 58-58221, a hook-shaped resilient member 105 having an inclined portion at its upper portion is fixed on a wick raising tube 104 so that a forward edge of the resilient member 105 is directed into said tube 104 through a proper opening, while a plurality of holes 107 which may engage a hook portion 105A of the resilient member 105 are formed in a wick holding tube 106 to be inserted into the tube 104 for positioning. For removing a wick 108 attached to the wick holding tube 106, a U-shaped plate jig 109 is inserted between the wick raising tube 104 and the wick holding tube 106 from a fire plate portion as in FIG. 2(B), so as to direct the resilient member 105 outwardly and release the hook portion 105A thereof from the engagement with the hole 107 for withdrawal of the wick 108. In the above arrangement, it is necessary to apply the exclusive jig 109 onto the outer periphery of the wick 108 through the fire plate portion for removal of the wick 108 as described above, and since a gap provided under the fire plate portion for movement of said wick 108 is formed to be as narrow as possible for safety purpose so long as the movement of the wick 108 is not obstructed thereby, the space around the wick 108 is still reduced by the insertion of the jig 109, thus making it difficult to draw out the wick 108 or giving rise to such an inconvenience that the jig 109 is caught by a reinforcing tape (not particularly shown) applied onto the wick 108, without reaching the necessary portion i.e. hook portion 105A. Furthermore, at the side portion of the wick 108 corresponding to the hook portion 105A, a cut-out opening must be provided to avoid the hook portion 105A, resulting in cutting off of the fuel sucking up path of the wick 108 by a considerable width, and this will not only obstruct the fuel drowing up function as a wick, but give rise to a fray of the cloth around such a cut-out opening which may hinder the wick raising or lowering function.

SUMMARY OF THE INVENTION

Accordingly, an essential object of the present invention is to provide an improved wick holder apparatus for a kerosene heater, which is capable of readily effecting replacement of a wick, while a superior fuel sucking or drowing up function may be achieved at high efficiency, with a substantial elimination of disadvantages inherent in the conventional arrangements of this kind.

Another important object of the present invention is to provide a wick holder apparatus of the above described type which is simple in construction and stable in functioning at high reliability, and can be readily incorporated into various kerosene heaters at low cost.

In accomplishing these and other objects, according to one preferred embodiment of the present invention, there is provided a wick holder apparatus for a kerosene heater which includes a cylindrical guide wick tube erected on a bottom portion of an oil tank, a cylindrical outer wick tube disposed around an outer periphery of the guide wick tube and a cylindrical wick concentrically disposed for upward and downward movements in an annular gap between the guide wick tube and the outer wick tube, and which is characterized in that there are further provided a wick holding tube releasably attached to an outer periphery of the wick for movement in one unit with the wick, and a wick moving tube movably provided for upward and downward movements within the oil tank and releasably engaged with the wick holding tube. The wick holding tube is provided with resilient engaging pieces projecting towards the wick moving tube, with said wick moving tube being formed with engaging openings or apertures which are engaged with the engaging pieces, while the engaging pieces of the wick holding tube are arranged to be resilient in a circumferential direction so as to be selectively fitted into or disengaged from the engaging openings or apertures of the wick moving tube through rotation of said wick holding tube.

By the arrangement according to the present invention as described above, an improved wick holder apparatus for a kerosene heater has been advantageously presented through a simple construction.

BRIEF DESCRIPTION OF THE DRAWINGS

These and other objects and features of the present invention will become apparent from the following description taken in conjunction with the preferred embodiment thereof with reference to the accompanying drawings, in which;

FIG. 2(A) is an exploded perspective view of another conventional wick holder apparatus (already referred to), FIG. 2(B) is a perspective view of the wick holder apparatus of FIG. 2(A) as assembled.

DETAILED DESCRIPTION OF THE INVENTION

Figures 1A, 1B:
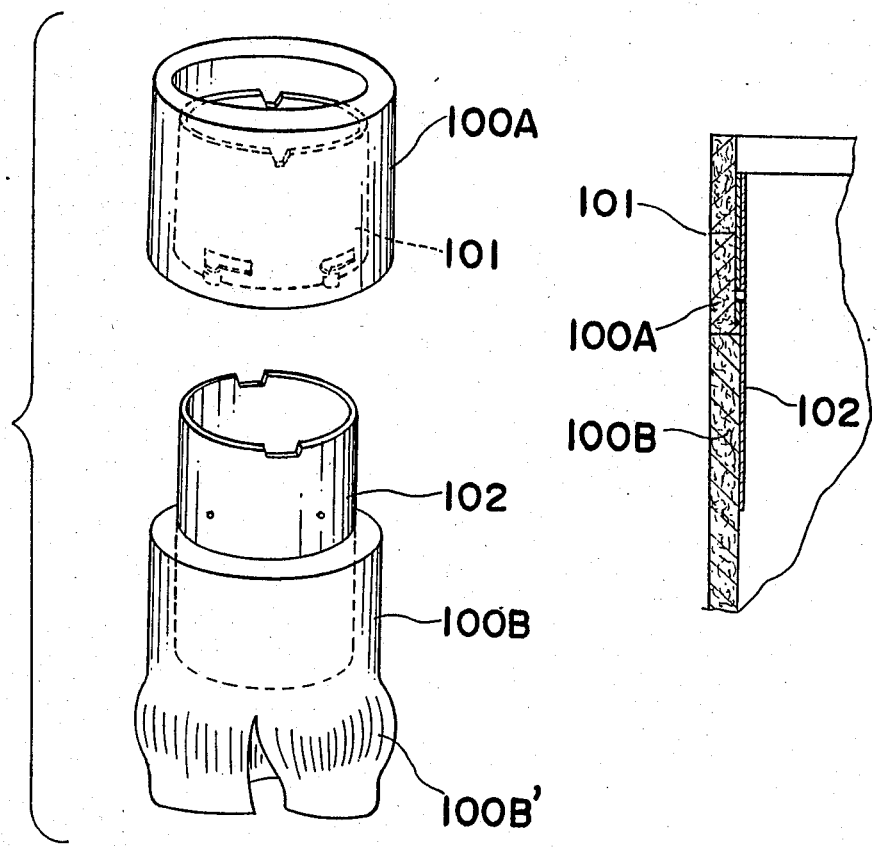
Fig. 1(A) PRIOR ART
Fig. 1(B) PRIOR ART
FIG. 1(A) is an exploded perspective view of a conventional wick holder apparatus (already referred to)
FIG. 1(B) is a fragmentary cross section showing, on an enlarged scale, the wick holder apparatus of FIG. 1(A) as assembled.

Before the description of the present invention proceeds, it is to be noted that like parts are designated by like reference numerals throughout the accompanying drawings.

Referring now to the drawings, there is shown in FIGS. 3 through 8, a wick holder apparatus for a kerosene heater according to one preferred embodiment of the present invention, which includes a cylindrical guide wick tube 2 (FIGS. 4 and 5) erected on a bottom portion of an oil tank 1, a cylindrical outer wick tube 11 disposed around an outer periphery of the guide wick tube 2 and a cylindrical wick 3 concentrically disposed for upward and downward movements in an annular gap between the guide wick tube 2 and the outer wick tube 11, and characterized in that there are further provided a wick holding tube 4 releasably attached to an outer periphery of the wick 3 for movement in one unit with said wick 3, and a wick moving tube 6 movably provided for upward and downward movements within said oil tank 1 and releasably engaged with the wick holding tube 4. The wick holding tube 4 is provided with resilient engaging pieces 5 projecting towards the wick moving tube 6, with the wick moving tube 6 being formed with engaging openings or apertures 10 which are engaged with the engaging pieces 5, while the engaging pieces 5 of the wick holding tube 4 are arranged to be resilient in a circumferential direction so as to be selectively fitted into or disengaged from the apertures 10 of the wick moving tube 6 through rotation of said wick holding tube 4.

More specifically, the cylindrical wick holding tube 4 surrounding the outer periphery of the wick 3 which is movably provided at the outer side of the guide wick tube 2 for the vertical movements, is formed, over its surface, with a plurality of claws 4*a* (FIG. 3) cut or forced into the wick 3 for enabling the wick 3 and the wick holding tube 4 to move as one unit without any slippage therebetween. The wick holding tube 4 as described above is made of a resilient or elastic material, and is provided, in the opposite portions on the outer peripheral wall thereof, with the rectangular engaging pieces 5 formed by cutting and raising part of said outer peripheral wall outwardly so as to be deflected or bent in a horizontal direction.

The wick moving tube 6 for moving the wick 3 upwardly or downwardly has a rack plate 7 provided at a portion of its outer peripheral wall and engaged with a pinion 9 of a wick moving shaft 8 extended from the outside of the tank 1 so as to be driven upwardly or downwardly. The above wick moving tube 6 is further formed, in the opposite portions of its outer peripheral wall, with apertures 10 in which the engaging pieces 5 of the wick holding tube 4 fitted in said wick moving tube 6 are engaged.

Figure 5:
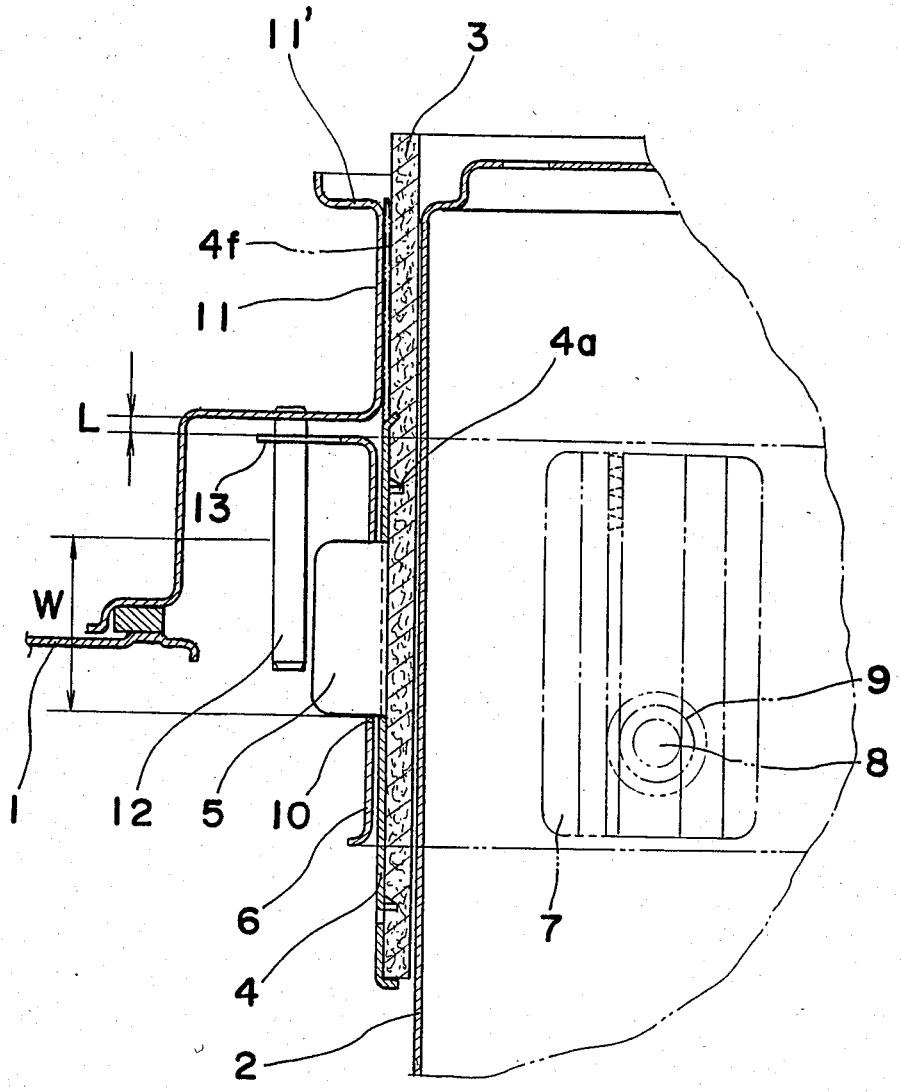
FIG. 5 is a view similar to FIG. 4, which particularly shows the wick after the mounting.

The outer wick tube 11 covering the outer periphery of the cylindrical wick 3 is formed with a fire plate portion 11' at its upper edge for receiving a combustion tube (not shown) thereon, and has guide pins 12 fixed at its lower peripheral portion so as to be loosely fitted into corresponding guide holes 13 formed at the outer peripheral portion of said wick moving tube 6. A wick inserting jig 14 is provided, at its forward end, with a notched portion 15 for supporting the wick holding tube 4. It is to be noted here that, as shown in FIG. 5, the width W of each engaging piece 5 of the wick holding tube 4 is adapted to be larger than a distance L between the wick moving tube 6 and the outer wick tube 11.

Figure 3:
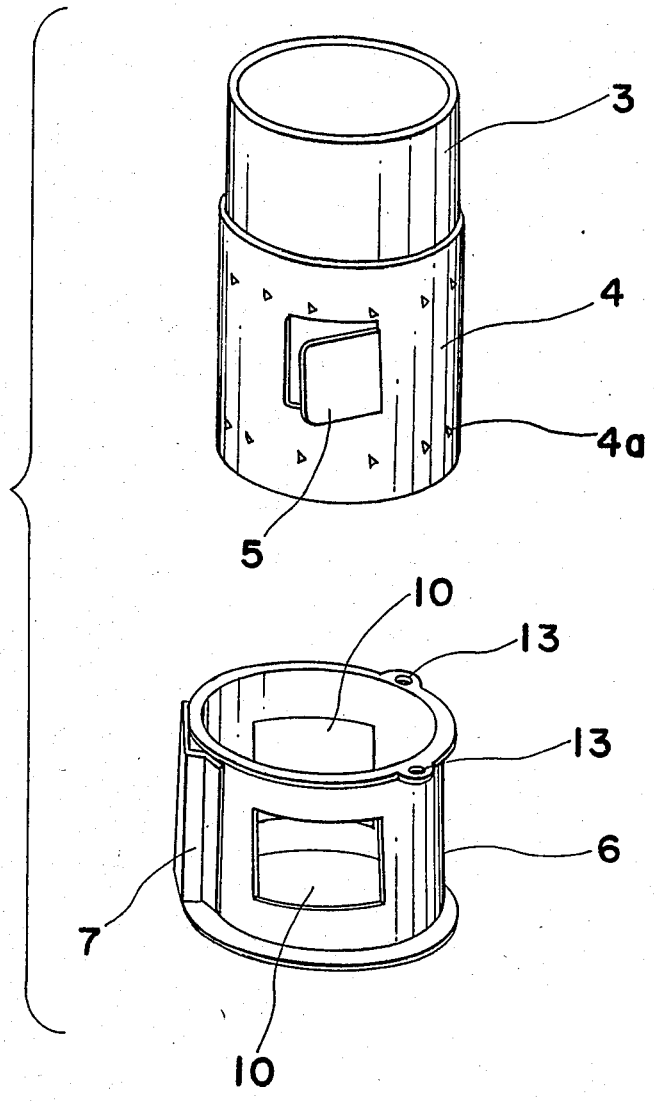
FIG. 3 is an exploded perspective view of an improved wick holder apparatus for a kerosene heater according to one preferred embodiment of the present invention.
Figure 6:
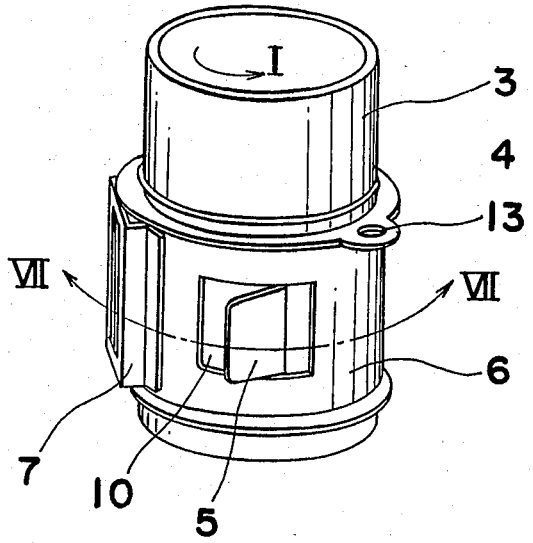
FIG. 6 is a perspective view of the wick holder apparatus of FIG. 3 in a state where the wick, a wick holding tube and a wick moving tube thereof are assembled with each other.
Figure 7:
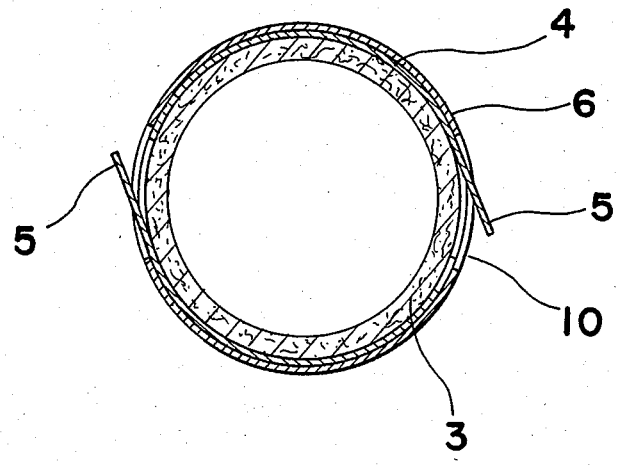
FIG. 7 is a cross section taken along the line V—V in FIG. 6, with a rack plate removed.
Figure 8:
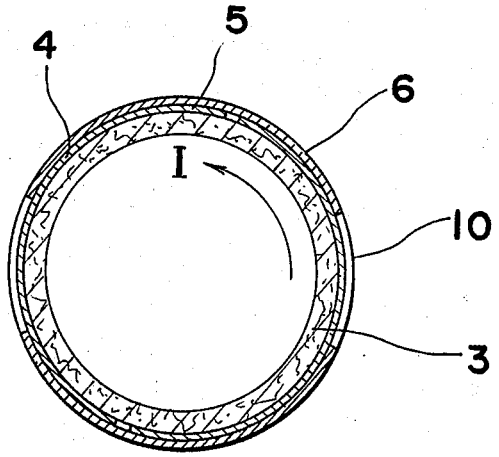
FIG. 8 is a cross section similar to FIG. 7, which particularly shows a state where engaging pieces of the wick holding tube are retreated into the wick moving tube, from engaging holes of said wick moving tube through rotation of the wick holding tube.

In the above arrangement, for the assembling at an initial stage, the cylindrical wick 3 is inserted into the wick holding tube 4 for fixing at the predetermined position as shown in FIG. 3, and is fitted into the wick moving tube 6, with the engaging pieces 5 of the wick holding tube 4 being engaged with the corresponding apertures 10 of the wick moving tube 6 as illustrated in FIG. 6. Subsequently, the above assembly as shown in FIG. 7 in a cross section is fitted over the guide wick tube 2, and the pinion 9 of the wick moving shaft 8 is engaged with the rack plate 7, while the guide pins 12 are fitted into the guide holes 13 of the wick moving tube 6, with the outer wick tube 11 being fixed to the oil tank 1 to complete the assembling.

The wick holder apparatus for the kerosene heater assembled in the manner as described so far is used by vertically moving the wick 3 through the wick moving shaft 8.

Subsequently, description will be made with reference to the case where the replacement of the wick becomes necessary while the apparatus is used as above.

In the first place, the cylindrical wick 3 is raised through rotation of the wick moving shaft 8, and then, forced to turn in the direction indicated by an arrow I in FIG. 6, with the forward edge of the wick 3 held by hand, whereby the engaging pieces 5 of the wick holding tube 4 are retreated or drawn into the wick moving tube 6 from the apertures holes 10 of said wick moving tube 6 so as to release the wick holding tube 4 from the engagement with the wick moving tube 6. Accordingly, when the wick 3 is pulled upwardly, with the upper edge thereof held by hand, the engaging pieces 5 of the wick holding tube 4 are raised as they are held inside the wick moving tube 6, and subsequently drawn into the outer wick tube 11 having an inner diameter generally equal to that of the wick moving tube 6 in the above state, and thus, the wick 3 may be withdrawn out of the apparatus in an efficient manner.

Thereafter, the wick 3 thus taken out is detached from the wick holding tube 4. This disengagement of the wick 3 may be easily effected by separating the outer peripheral surface of the wick 3 from the claws **4*a* of the wick holding tube 4. Subsequently, a fresh wick 3 is inserted into the wick holding tube 4 and the peripheral surface of the fresh wick 3 is pressed against the claws 4*a* of the wick holding tube 4** for combining the both into one unit.

The new wick 3 thus attached on the wick holding tube 4 is mounted onto the apparatus in a manner as described hereinbelow.

Figure 4:
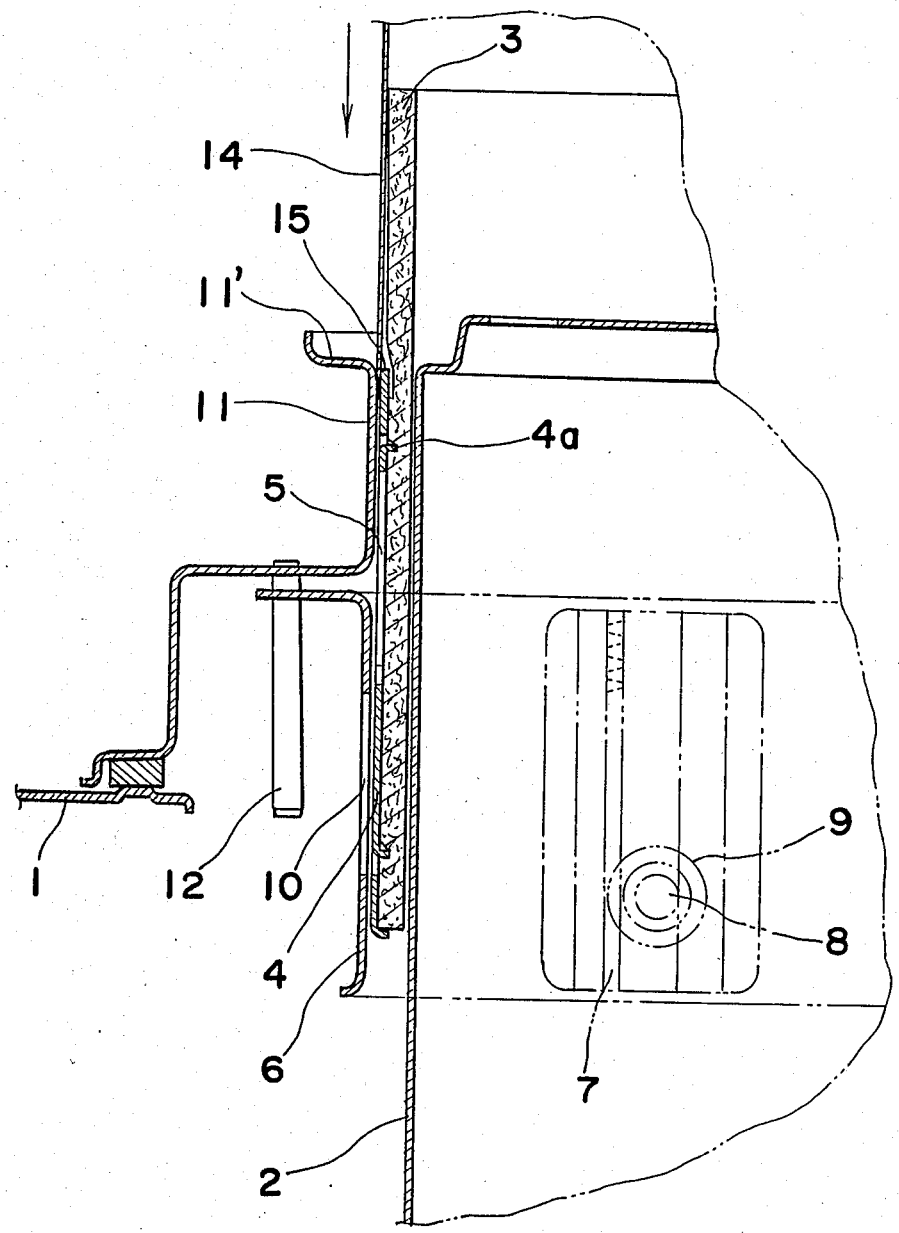
FIG. 4 is a fragmentary side sectional view showing, on an enlarged scale, an essential portion of the wick holder apparatus of FIG. 3, with its wick during mounting.

Firstly, by holding the wick moving tube 6 in a state where it is raised up to an upper limit, the wick holding tube 4 attached with the new wick 3 is inserted, from its lower edge, into a wick raising and lowering gap provided between the guide wick tube 2 and the outer wick tube 11 as shown in FIG. 4, with the engaging pieces 5 of the wick holding tube 4 aligned with the apertures 10 of the wick moving tube 6, and the engaging pieces 5 expanding outwardly are pressed into the outer wick tube 11 (or depending on necessity, they are slipped into the wick moving tube 6 by being depressed downwardly through application of the jig 14), whereby said engaging pieces 5 spontaneously expand outwardly by the own resiliency thereof at the portions of the engaging holes 10 for engagement therewith.

In the above case, if the upper edge of the wick holding tube 4 has been extended up to the vicinity of the fire plate portion 11' as shown by a one-dot chain line **4*f* in FIG. 5, the wick 3 may be readily set, even without use of the jig 14**.

By the above construction, the wick 3 may be detached only by pulling up, while being rotated in the predetermined direction with its upper edge held by hand, and since the engaging pieces 5 are expanding outwardly, it is not necessary to provide notches in the wick 3, which may hinder the fuel drowing up capacity of said wick 3. Meanwhile, if the engaging pieces 5 are formed by cutting and raising portions of the wick holding tube 4 made of a resilient material, they may be produced from one part for a favorable economical effect. Upon removal of the wick 3, although it may be difficult to hold the wick moving tube 8 with its concentricity with respect to the guide wick tube 2 maintained, any large positional deviation at least at the upper edge thereof may be prevented by the engagement of the guide pins 12 provided in the outer wick tube 11 in the vertical direction and the guide holes 13 in the wick moving tube 6, and this arrangement is particularly convenient for re-insertion of the wick 3.

Incidentally, a wick generally has a soft portion at its lower portion as shown at 100B' of the wick in FIG. 1(A) for drawing up or sucking up the fuel in a liquid form, and even if such a wick is adapted to be supported by a wick holder as described above, there are many cases where the lower soft portion (i.e. fuel drowing up portion) of the wick is difficult to be inserted or can not be properly inserted into the wick raising or lowering gap between the guide wick tube and the outer wick tube. Therefore, in the embodiment of FIGS. 3 to 8 as described so far, the lower portion (i.e. fuel drowing up portion) of the wick 3 is shortened, and simultaneously, provided with a rigidity to a certain extent in the similar manner as in the burning portion at the upper portion of the wick. In the above case, however, since the fuel drowing up portion at the lower portion of the wick 3 is not bent or deflected when the wick 3 is lowered, there is such a problem that a depth of the oil tank 1 must be increased.

Figure 9:
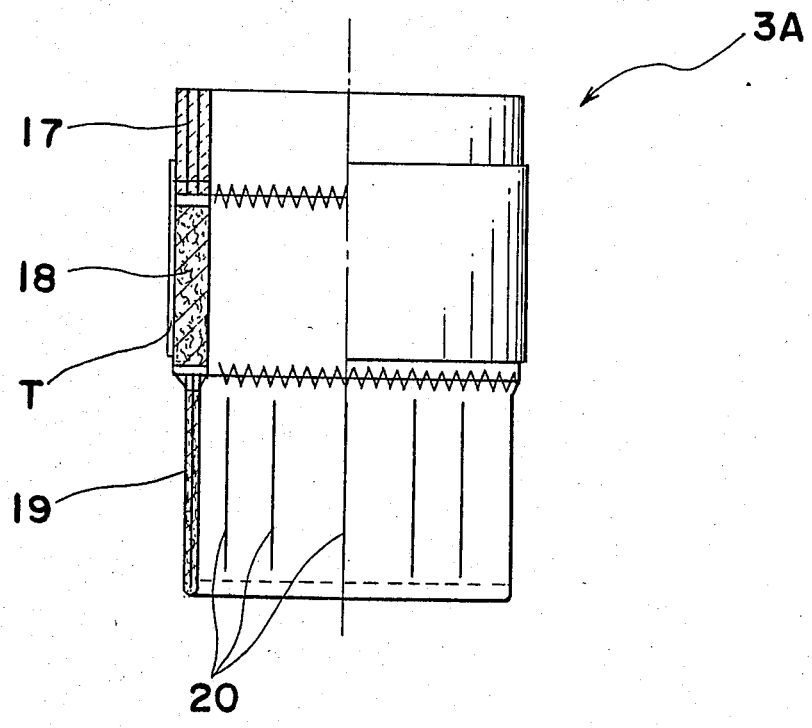
FIG. 9 is a side elevational view, partly in section, of a wick according to another embodiment of the present invention.

Referring to FIG. 9, there is shown a wick 3A according to the present invention, intended to solve the problem as referred to above.

The wick 3A of FIG. 9 includes a burning portion 17 formed in a thick layer by sewing together cloth layers woven by a heat resistant material such as glass fibers, double twill elastic webs or the like, a drowing up accelerating portion 18 made of a thick cloth of cotton, staple fibers or the like and sewn to the lower portion of the burning portion 17, a fuel drowing up portion 19 further sewn to the lower edge of the drowing accelerating portion 18, and a reinforcing tape T applied to the outer periphery of said burning portion 17 and the drowing up accelerating portion 18.

The fuel drowing up portion 19 is formed by a cloth such as a flannel or the like having coarse warps and wefts small in the count, and applied with a starch glue for subsequent drying, and includes one or a plurality of sheets of such cloths stretched by ironing or the like and piled one upon another so as to be sewn together, with the warps directed in the longitudinal direction. The fuel drowing up portion 19 is further formed with a plurality of vertical cuttings or slits 20 at its intermediate portion so that the portion 19 is split sidewise into a plurality of portions at the slits 20 when subjected to a compression in the vertical direction.

In the above construction, for replacing the wick, a new wick 3A is first attached to the wick holding tube 4, and then, the fuel drowing up portion 19 is forced, at its lower edge, into the wick raising and lowering gap between the outer wick tube 11 and the guide wick tube 2 for engagement of the engaging pieces 5 of the wick holding tube 4 with the apertures 10 of the wick moving tube 6.

In the above case, according to the wick 3A of the present invention shown in FIG. 9, since the fuel drowing up portion 19 is formed to be smaller in thickness than the upper wick portions 17 and 18, the wick 3A may be smoothly inserted into said wick raising and lowering gap. Moreover, owing to the stretching by the application of the starch glue or the like, there is no possibility that the wick 3A is stopped on the way during insertion thereof into the wick raising and lowering gap due to wrinkling or bending thereof. Meanwhile, when the wick 3 is brought into the state of extinguishment (i.e. the lowered state), the fuel drowing up portion 19 is split outwardly by the presence of the vertical slits 20 so as to be bent thereat, and thus, the wick 3A may be sufficiently lowered without any obstruction. Particularly, since the fuel drowing up portion 19 is made thin, the split portions may be readily deflected or bent upon lowering, and thus, a smooth wick raising and lowering function can be achieved.

Referring further to FIGS. 10 to 13, there is shown another embodiment of a wick according to the present invention, in which the ironing work as required in the wick 3A of FIG. 9 is eliminated.

The wick 3B according to the present invention as illustrated in FIGS. 10 through 13 includes a fuel drowing up portion 21 formed by a non-woven fabric prepared by accumulating short fiber random webs of rayon, etc. on opposite surfaces of a fabric of rayon or fibers, a drowing up accelerating portion 22 formed by coarse warps and wefts prepared by twisting glass fibers, cotton and other fibers and sewn to the upper portion of the fuel drowing up portion 21, a heat-resistant burning portion 23 formed by glass fibers or mixed spun yarns of glass fibers and carbon fibers (flame-resistant fibers) and sewn to the upper portion of the drowing up accelerating portion 22, and a reinforcing tape 24 of cotton or the like applied onto the outer periphery of the wick.

Figure 10:
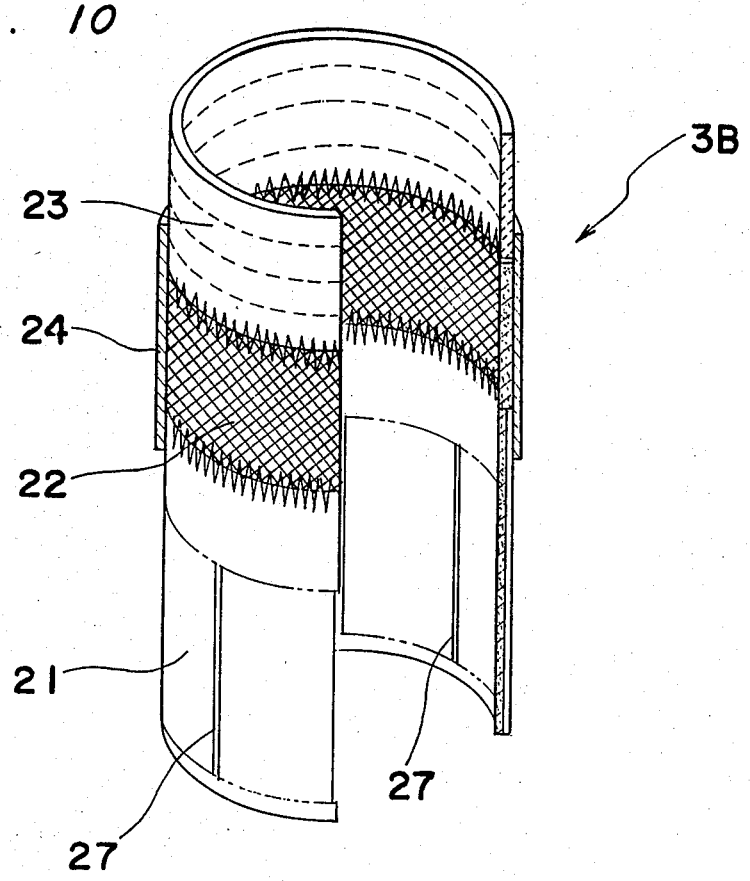
FIG. 10 is a perspective view, partly broken away, of a wick according to still another embodiment of the present invention.
Figure 11:
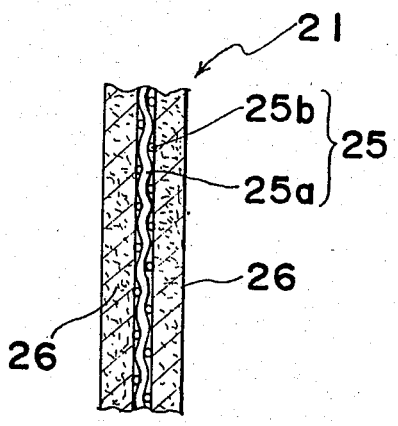
FIG. 11 is a fragmentary cross sectional view showing, on an enlarged scale, an essential portion of the wick of FIG. 10.
Figure 12:
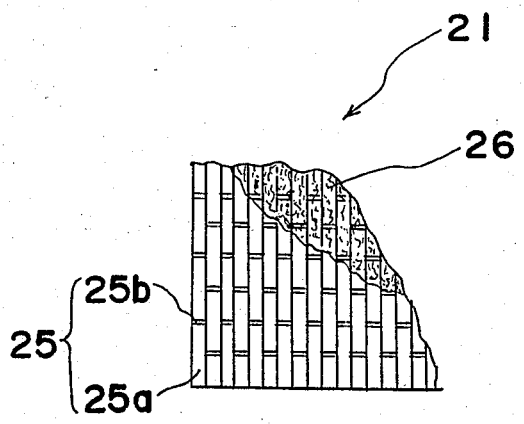
FIG. 12 is a fragmentary side elevational view showing, on an enlarged scale, an essential portion of the wick of FIG. 10.

In the above construction, as shown in FIGS. 11 and 12, the fuel drowing up portion 21 which becomes the lowest portion of the wick 3B is constituted by a base member 25 prepared by combining long fibers such as rayon or the like vertically aligned generally in parallel relation to each other or by weaving fine wefts **25*b* into coarse warps 25*a* prepared by twisting either one of long or short fibers or mixed fibers, and short fiber random web 26 of rayon or the like integrally applied onto opposite surfaces of said base member 25 through a needle punch processing and the like, with a plurality of slits 27 being vertically formed in said portion 21 as shown in FIG. 10**.

Figure 13:
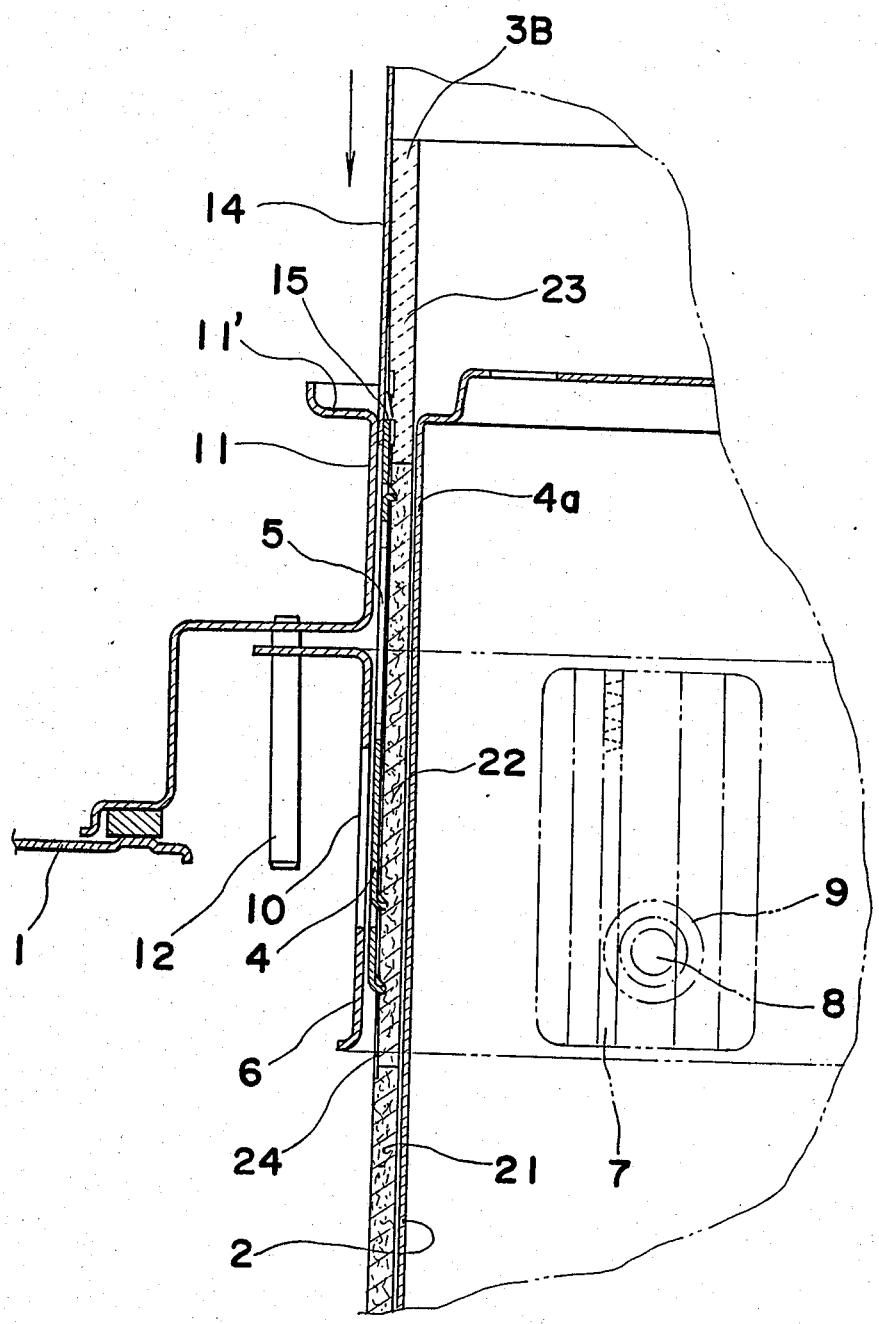
FIG. 13 is a fragmentary side sectional view showing on an enlarged scale, the wick, holder apparatus of the present invention during mounting of the wick of FIG. 10.

The fuel drowing up portion 21 as described above has a comparatively large strength even without ironing owing to the integral structure of the base member 25 and the short fibers random web 26, and is readily inserted into the wick raising and lowering gap between the guide wick tube 2 and the outer wick tube 11 in the similar manner as in the wick 3A of FIG. 9. FIG. 13 shows the wick 3B of FIGS. 10 to 12 during mounting onto the wick holder apparatus.

The wick 3B as described so far has various other features as follows.

In the fuel drowing up portion 21 of the above wick 3B, since the base member 25 is constituted by uniformly combining the fine wefts **25*b* with the coarse warps 25*a*, said base member 25 thus formed is not easily loosened, with a consequent improvement of durability. Moreover, owing to the fact that the base member 25 is subjected to the needle punch processing so as to integrally accumulate the fibers such as rayon, etc. in the form of a random web, the fuel drowing up portion 21** may be readily controlled for its overall dimensions.

Moreover, since the base member 25 of the fuel drowing up portion 21 employs coarse twisted yarns or bundles of long fibers for the warps **25*a* which serve as the fuel passage in the vertical direction, and the fine yarns for the wefts 25*b*** which provide a resistance in the fuel passage, the speed for drowing up the fuel may be sufficiently increased, thereby making it possible to supply an ample fuel to the burning portion.

Furthermore, in the wick 3B according to the present invention as described above, since the drowing up accelerating portion 22 constituted by the coarse warps and wefts are sewn to contact the upper portion of the fuel drowing up portion 21, a sufficient amount of kerosene may be retained in the wick, so that re-ignition after the extinguishment may be rapidly and positively effected, while the burning thereafter may be quickly stabilized.

As is clear from the foregoing description, according to the arrangement of the present invention, not only the wick can be readily replaced, but no jig is required during the replacement of the wick, and thus, the wick may be smoothly withdrawn from the wick raising and lowering gap. Moreover, owing to the arrangement that the wick is engaged with the wick moving tube through the engaging pieces of the wick holding tube attached to the outer periphery of the wick, it is not necessary to provide engaging openings in the wick itself, and thus, the fuel drowing up function of the wick may be favorably maintained. Furthermore, the wick is not required to be separated into the burning portion and the fuel drowing up portion, with a reduction in the number of parts involved, thus making it possible to achieve a marked reduction in cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. In a wick holder apparatus for a kerosene heater which comprises a cylindrical guide wick tube erected on a bottom portion of an oil tank, a cylindrical outer wick tube disposed around an outer periphery of said guide wick tube, and a cylindrical wick concentrically disposed for upward and downward movement in an annular gap between said guide wick tube and said outer wick tube, a wick holding tube releasably attached to an outer periphery of the wick for movement as one unit with said wick, and a wick moving tube movably provided for upward and downward movements within said oil tank and releasably engaged with said wick holding tube, the improvement which comprises providing said wick holding tube with at least one cut out portion which resiliently extends from the peripheral outer surface of said wick holding tube, said wick moving tube being provided with at least one aperture, whereby upon rotation of the wick holding tube relative to the wick moving tube the cut out portion is caused to selectively engage or disengage from said aperture.

2. The wick holder apparatus as claimed in claim 1, wherein said wick holding tube is provided with a plurality of projections which extend from the internal peripheral wall surface of said wick holding tube, said projections penetrating into said wick to form a single unit.

3. The wick holder apparatus as claimed in claim 1, wherein said wick includes a burning portion woven in a thick layer and a fuel drowing up portion made of a cloth smaller in thickness than said burning portion and sewn to said burning portion, said fuel drowing up portion being hardened through application thereto of a starch glue and the like, and formed, at its intermediate portion, with a plurality of slits.

4. The wick holder apparatus as claimed in claim 1, wherein said wick includes a heat-resistant burning portion and a fuel drowing up portion, said fuel drowing up portion being prepared by a base member and short fiber random web layers applied onto said base member into one unit so as not to be separated therefrom.

5. The wick holder apparatus as claimed in claim 4, wherein said base member for the fuel drowing up portion is made of a fabric formed by collecting long fibers merely in one direction or a fabric formed by coarse warps and fine wefts.

6. The wick holder apparatus as claimed in claim 4, wherein said short fiber random web layers of the fuel drowing up portion are formed into one unit with said base member.

7. The wick holder apparatus as claimed in claim 4, wherein slits are formed in said fuel drowing up portion.

8. The wick holder apparatus as claimed in claim 1, wherein said resilient cut out portion comprises two rectangular engaging pieces cut out and extending from opposite portions on the peripheral wall of said wick holding tube, said apertures including correspoinding rectangular openings formed in said wick moving tube for engagement with said cut out portions.

* * * * *